US009156263B2

(12) United States Patent
Kodoi et al.

(10) Patent No.: US 9,156,263 B2
(45) Date of Patent: Oct. 13, 2015

(54) LIQUID EJECTION HEAD AND METHOD OF PRODUCING THE SAME

(71) Applicant: CANON KABUSHIKI KAISHA, Tokyo (JP)

(72) Inventors: Takuma Kodoi, Kawasaki (JP); Takuya Iwano, Inagi (JP); Keiji Tomizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/519,297

(22) Filed: Oct. 21, 2014

(65) Prior Publication Data

US 2015/0130873 A1 May 14, 2015

(30) Foreign Application Priority Data

Nov. 13, 2013 (JP) ..... 2013-235145

(51) Int. Cl.
*B41J 2/14* (2006.01)
*B41J 2/16* (2006.01)

(52) U.S. Cl.
CPC *B41J 2/1433* (2013.01); *B41J 2/16* (2013.01); *B41J 2/1607* (2013.01); *B41J 2/1648* (2013.01); *B41J 2002/14491* (2013.01)

(58) Field of Classification Search
USPC ..... 347/50, 87, 86
See application file for complete search history.

(56) References Cited

U.S. PATENT DOCUMENTS

| | | | |
|---|---|---|---|
| 8,544,977 | B2 | 10/2013 | Kodoi |
| 2013/0286091 | A1 | 10/2013 | Takahashi et al. |
| 2013/0286099 | A1 | 10/2013 | Muraoka et al. |

FOREIGN PATENT DOCUMENTS

JP 2007-320229 A 12/2007

*Primary Examiner* — Henok Legesse
(74) *Attorney, Agent, or Firm* — Fitzpatrick, Cella, Harper & Scinto

(57) ABSTRACT

A liquid ejection head includes a recording element substrate for ejecting liquid in response to an externally supplied electrical signal; an electrical wiring board having a first and second part mutually joined via a bent portion, the first part having an electrical joint portion for supplying the signal to the substrate, the second part having an electrical signal input portion into which the signal is input and to which the joint portion is connected; and a housing having first and second surfaces mutually adjoining, the first and second surfaces respectively supporting the first and second parts. The second part is fixed to the second surface at plural first fixing positions around the input portion. The second surface has a depressed portion formed closer to the bent portion than the first fixing positions. The second part is fixed to the housing at a second fixing position inside the depressed portion.

16 Claims, 7 Drawing Sheets

LIQUID EJECTION HEAD AND METHOD OF PRODUCING THE SAME

BACKGROUND OF THE INVENTION

1. Field of the Invention

The present invention relates to a liquid ejection head to be used in a liquid ejection apparatus for ejecting liquid such as ink to form an image or perform recording, and to a method of producing the liquid ejection head.

2. Description of the Related Art

A liquid ejection head forms an image by ejecting liquid droplets. The liquid droplets are ejected by heating the liquid by an energy-generating element including a heat generating resistor, thereby causing film boiling in the liquid. Alternatively, a piezoelectric element may be used sometimes to eject the liquid droplets, or a method involving irradiating the liquid with an electromagnetic wave generated by a laser or the like is also sometimes employed. Such a liquid ejection head is generally mounted on a recording apparatus main body. The liquid ejection head is controlled and driven by an electrical signal supplied from the recording apparatus main body to form an image. Therefore, in order to form an image by the liquid ejection head, electrical communication is necessary between the recording apparatus main body and the liquid ejection head.

In order to achieve the electrical communication, the liquid ejection head includes an electrical wiring board for electrically connecting the energy-generating element and the recording apparatus main body. The electrical wiring board includes an electrical signal input portion including conductive contact pads, and the recording apparatus main body includes contact pins to be electrically connected to the contact pads, respectively. The contact between the contact pad and the contact pin enables the electrical communication. As disclosed in Japanese Patent Application Laid-Open No. 2007-320229, the electrical wiring board is formed of a flexible wiring board in which a plurality of electrical wiring lines are arranged in a single layer, and the contact pads are provided directly on the flexible wiring board. In order to reduce the size of the electrical signal input portion, a multilayer wiring board in which a plurality of electrical wiring lines are arranged in a plurality of layers is sometimes connected to the flexible wiring board, and the contact pads are formed on the multilayer wiring board. The electrical wiring board is bent along two surfaces of a housing of the liquid ejection head at the stage of producing the liquid ejection head, and is crimped around the electrical signal input portion (for example, at four positions).

The main portion of the electrical wiring board, in particular, a bent portion is made of a flexible material such as a flexible wiring board, but it is difficult to bend the electrical wiring board completely along the shape of the housing. Therefore, when the electrical wiring board is bent, lifting may occur near the bent portion. FIG. 12A is a perspective view illustrating the relationship between a liquid ejection head 1 and a sheet P on which an image is to be recorded, and FIG. 12B is a sectional view taken along the line 12B-12B of FIG. 12A. An electrical wiring board 5 is first bonded to a first surface 33 of a housing 6, which is located on the same side as ejection orifices, and is then bent by about 90° along the corner of the housing 6 to be fixed along a second surface 34 of the housing 6. At this time, lifting C occurs near a bent portion 21 due to the bending rigidity of the electrical wiring board. This tendency is remarkable in an electrical wiring board having a large area in a region other than the electrical signal input portion or in a wide electrical wiring board. The lifting of the electrical wiring board occurs not only during production but also due to heat after usage and change over the years. Such lifting near the bent portion 21 leads to increase in dimension of the liquid ejection head in the traveling direction (hereinafter referred to as "Y direction") of the sheet P (hereinafter referred to as "Y direction dimension Dy") as illustrated in FIG. 12B.

The increase in the Y direction dimension Dy causes the following problems. As illustrated in FIGS. 12A and 12B, on both sides of the liquid ejection head 1 in the Y direction, sheet pressing rollers 61*a* and 61*b* are respectively provided. The sheet pressing rollers 61*a* and 61*b* are located near the housing 6 of the liquid ejection head 1 in order to satisfactorily press the sheet P in the vicinity of the ejection orifices. Therefore, the sheet pressing roller 61*a* on the side of the second surface 34 of the housing 6 of the liquid ejection head 1 may interfere with the electrical wiring board 5 protruding due to the lifting. In order to avoid this interference, it is necessary to separate the sheet pressing roller 61*a* away from the second surface 34 as indicated by the broken lines. In this case, an interval L between the two sheet pressing rollers 61*a* and 61*b* increases. The increase in the interval L causes problems such as printing failure and paper jam due to reduction of the effect to press the sheet by the sheet pressing rollers 61*a* and 61*b*. The paper jam often occurs if the sheet is unsatisfactorily pressed particularly when the sheet enters the space below the liquid ejection head 1 during sheet feeding. Further, in a general small-sized recording apparatus, with increasing printing speed in recent years, the longitudinal direction (Y direction) dimension of the ejection orifice array tends to increase. In such a recording apparatus, as the Y direction dimension of the liquid ejection head increases, accordingly, the interval between the sheet pressing rollers also tends to increase, and hence the interval between the sheet pressing rollers further increases due to the occurrence of the above-mentioned lifting.

In order to reduce the height of the lifting, it is also conceivable to crimp and fix the electrical wiring board while strongly pulling the electrical wiring board. In this case, however, the electrical wiring board is fixed under a tensioned state, and hence a crimped part of the electrical wiring board may be cracked after the tension is released, or another part thereof may be wrinkled. Therefore, the above-mentioned problems cannot be solved.

SUMMARY OF THE INVENTION

The present invention has an object to provide a liquid ejection head and a method of producing the liquid ejection head, which are capable of suppressing protrusion due to lifting of an electrical wiring board fixed to a housing.

According to an embodiment of the present invention, there is provided a liquid ejection head, including:

a recording element substrate for ejecting liquid in response to an electrical signal supplied from the outside;

an electrical wiring board having a first part and a second part that are joined to each other via a bent portion, the first part including an electrical joint portion for supplying the electrical signal to the recording element substrate, the second part including an electrical signal input portion into which the electrical signal is input and to which the electrical joint portion is connected; and a housing having a first surface and a second surface that are adjacent to each other, the first surface supporting the first part, the second surface supporting the second part, wherein:

the second part of the electrical wiring board is fixed to the second surface of the housing at a plurality of first fixing positions around the electrical signal input portion, the second surface includes a depressed portion formed closer to the bent portion than the plurality of first fixing positions, the second part is fixed to the housing further at at least one second fixing position located inside the depressed portion.

Further, according to another embodiment of the present invention, there is provided a liquid ejection head, including:

a recording element substrate including an element for generating energy to be used for ejecting liquid;

an electrical wiring board including:

a bent portion;

a connection portion which is provided on a first part on one side of the bent portion and which is for connection with the recording element substrate; and an input portion which is provided on a second part on the other side of the bent portion and into which a signal to be supplied to the recording element substrate is input; and a housing including:

a first surface for supporting the first part of the electrical wiring board;

a second surface for supporting the second part of the electrical wiring board; and a depressed portion formed in the second surface, wherein a region between the bent portion and the input portion in the electrical wiring board is fixed to the depressed portion.

Further, according to another embodiment of the present invention, there is provided a method of producing a liquid ejection head, including:

fixing, to a first surface of a housing, a first part of an electrical wiring board including an electrical signal input portion into which an electrical signal supplied from the outside is input and an electrical joint portion for supplying the electrical signal to a recording element substrate for ejecting liquid in response to the electrical signal, the electrical joint portion being electrically connected to the electrical signal input portion, the first part including the electrical joint portion;

bending a second part of the electrical wiring board where the electrical signal input portion is provided with respect to the first part so as to form a bent portion;

fixing the bent second part of the electrical wiring board to a second surface of the housing which is adjacent to the first surface at a plurality of first fixing positions around the electrical signal input portion; and fixing the bent second part of the electrical wiring board to the housing at at least one second fixing position located inside a depressed portion formed in the second surface, the at least one second fixing position being located closer to the bent portion than any of the plurality of first fixing positions.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A liquid ejection head and a method of producing the liquid ejection head according to embodiments of the present invention are described with reference to the drawings. The liquid ejection head of the present invention is typically applied to an ink jet liquid ejection head for ejecting ink, but may be configured to eject desired liquid other than ink depending on its application.

First Embodiment

Figure 1:
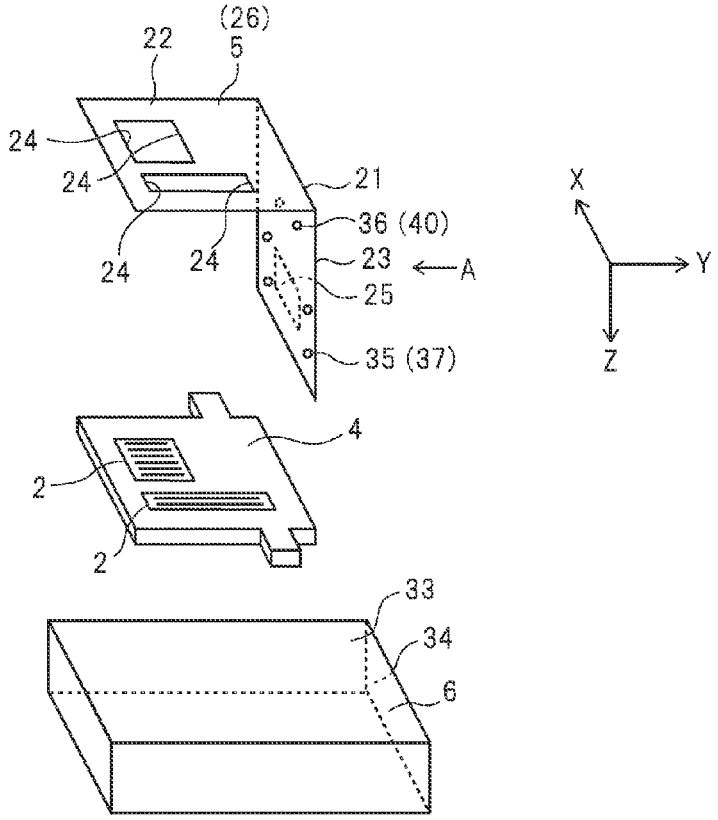
FIG. 1 is a main part exploded perspective view of a liquid ejection head according to an embodiment of the present invention.
Figure 2A:
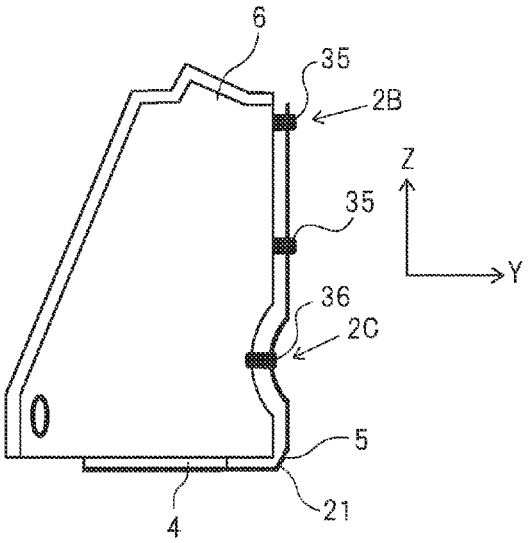
FIGS. 2A, 2B and 2C are side views of the liquid ejection head illustrated in FIG. 1.
Figure 2B:
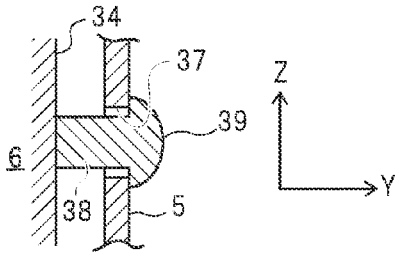
Figure 2C:
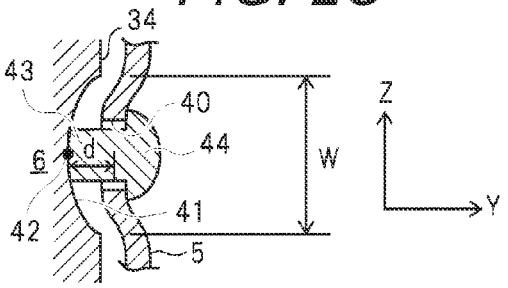

FIG. 1 is a main part exploded perspective view of a liquid ejection head 1. FIG. 2A is a main part side view of the liquid ejection head 1 (upside down with respect to FIG. 1), and FIGS. 2B and 2C are enlarged views of the part 2B and the part 2C of FIG. 2A, respectively. The liquid ejection head 1 includes a recording element substrate 2 for ejecting liquid in response to an electrical signal, a support member 4 for supporting the recording element substrate 2, an electrical wiring board 5, and a housing 6 for supporting the support member 4 and the electrical wiring board 5.

Figure 3:
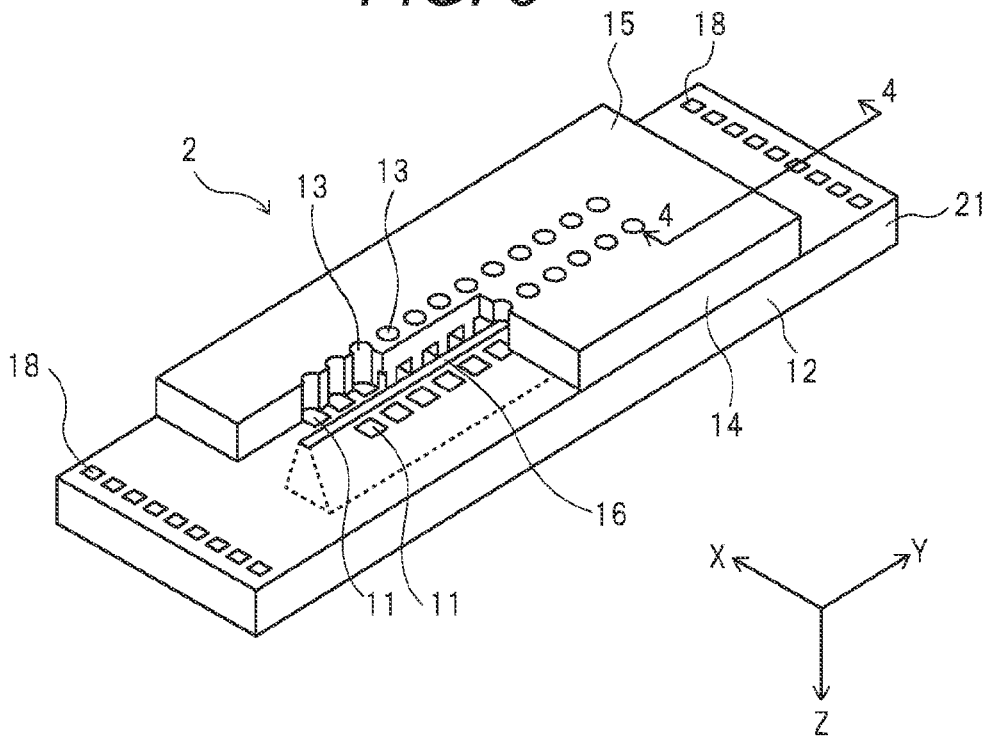
FIG. 3 is a perspective view of a recording element substrate.
Figure 4:
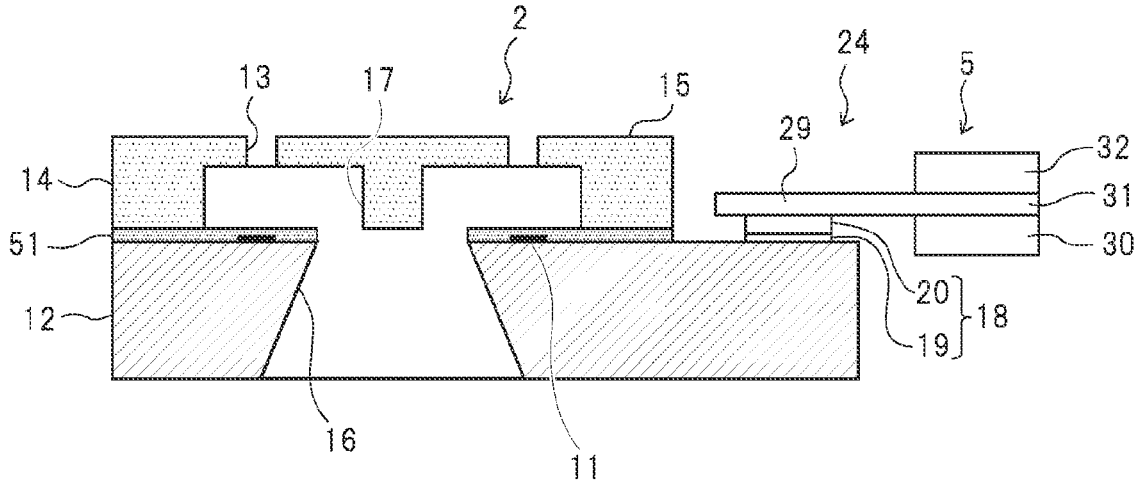
FIG. 4 is a sectional view taken along the line 4-4 of the recording element substrate illustrated in FIG. 3.

FIG. 3 is a perspective view of the recording element substrate 2, and FIG. 4 is a sectional view taken along the line 4-4 of FIG. 3. The recording element substrate 2 includes a silicon support substrate 12 having energy-generating elements 11 each including a heat generating resistor formed thereon, and an ejection-orifice-forming member 14 including a plurality of ejection orifices 13 and covering a part of the support substrate 12. The ejection-orifice-forming member 14 includes the ejection orifices 13 for ejecting liquid, which are located on an ejection orifice forming surface 15, and a pressure chamber 17 for guiding the liquid to the ejection orifices 13. The ejection-orifice-forming member 14 is fixed to the support substrate 12 with an adhesive 51. A liquid supply port 16 having an elongated opening shape is formed at the center of the support substrate 12. On the support substrate 12 on both sides of the liquid supply port 16, the energy-generating elements 11 are formed so as to face the pressure chamber 17 at substantially equal intervals in a Y direction. On the support substrate 12, a wiring (not shown)

made of aluminum or the like for supplying power to the energy-generating elements 11 is led in and arranged, and this wiring is electrically connected to support a substrate terminal 18 placed on both ends of the support substrate 12. The support substrate terminal 18 includes an electrode pad 19, and a bump 20 serving as an electrode formed thereon. Liquid is supplied from the liquid supply port 16, heated by the energy-generating elements 11, and shaped into liquid droplets due to the action of film boiling to be ejected from the ejection orifices 13. As the energy-generating element 11, a piezoelectric element may be used instead of the heat generating resistor, and an element for generating an electromagnetic wave such as laser may also be used.

Figure 5:
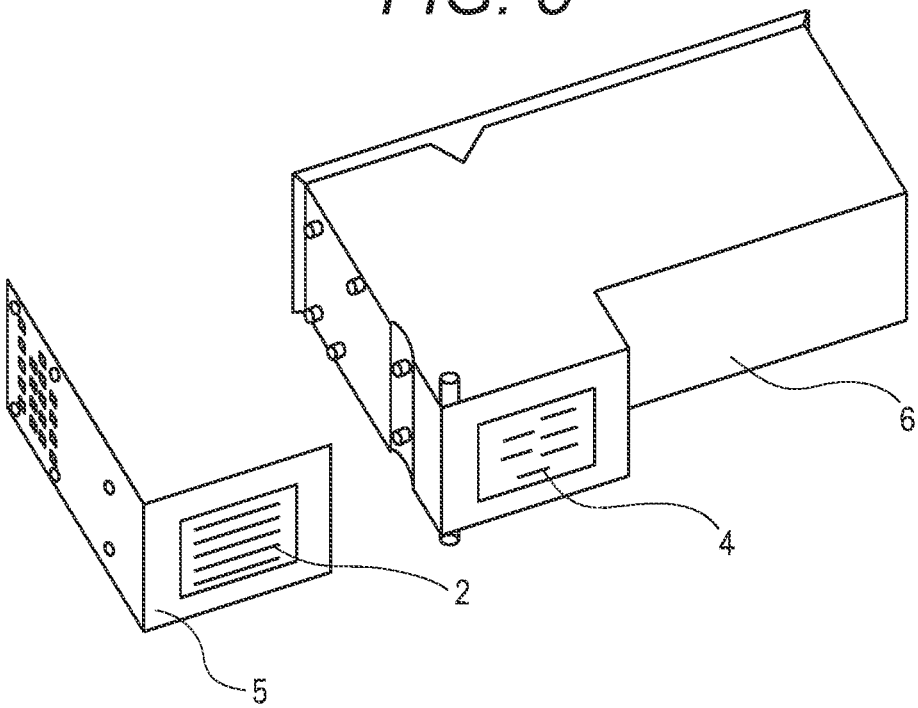
FIG. 5 is a main part exploded perspective view of a liquid ejection head according to the embodiment of the present invention.

The support member 4 is made of a hard material such as ceramics or a soft material such as resins. A liquid flow path (not shown) that communicates with the liquid supply port 16 is formed in the support member 4 at a position corresponding to the liquid supply port 16 of the support substrate 12. The entire region of the back surface of the support substrate 12, which does not face the ejection-orifice-forming member 14, is bonded to the support member 4 with an adhesive. As illustrated in FIG. 5, the support member 4 may be formed as a part of the housing 6.

With reference to FIGS. 1 and 2A to 2C, the electrical wiring board 5 includes first and second parts 22 and 23 joined to each other via a bent portion 21. An electrical joint portion 24 for supplying, to the recording element substrate 2, drive power for the energy-generating element 11 or electrical signals such as a control signal is formed in the first part 22, and an electrical signal input portion 25 into which the above-mentioned electrical signals supplied from the outside (recording apparatus main body) are input is formed in the second part 23. The electrical wiring board 5 is formed of a flexible wiring board 26, and the electrical signal input portion 25 is formed on the flexible wiring board 26. The electrical signal input portion 25 includes metal contact pads 28 via which the electrical signals are input from the recording apparatus main body (see FIG. 6). Electrical communication is achieved through contact between the contact pads 28 and the contact pins (not shown) mounted on the recording apparatus main body.

The electrical joint portion 24 of the electrical wiring board 5 includes an electrical wiring board terminal to be electrically connected to the bump 20 of the recording element substrate 2. The flexible wiring board 26 includes a base film 30, and copper foil 31 bonded on the base film 30 with an adhesive. The copper foil 31 is patterned so as to function as wiring for connecting the electrical signal input portion 25 to the electrical joint portion 24. The electrical wiring board 5 is covered with a cover film 32 except for the contact pad 28 and the electrical wiring board terminal 29. The support substrate terminal 18 and the electrical wiring board terminal 29 are metal-joined by ultrasonic waves and heat to be electrically connected to each other. The electrical wiring board 5 extends substantially parallel to the ejection orifice forming surface 15 of the recording element substrate 2.

The housing 6 is a resin support structure for supporting the recording element substrate 2, the electrical wiring board 5, and the support member 4. The housing 6 has first and second surfaces 33 and 34 that are adjacent to each other. The first surface 33 supports the first part 22 of the electrical wiring board 5, and the second surface 34 supports the second part 23 of the electrical wiring board 5. The first surface 33 extends substantially parallel to the ejection orifice forming surface 15. The entire surface of the first part 22 of the electrical wiring board 5 is fixed to the first surface 33 of the housing 6 with an adhesive. The second part 23 of the electrical wiring board 5 is fixed to, as described in detail below, the second surface 34 of the housing 6 at a plurality of first fixing positions 35 and at least one second fixing position 36. Those fixing positions 35 and 36 are located apart from each other.

Figure 6:
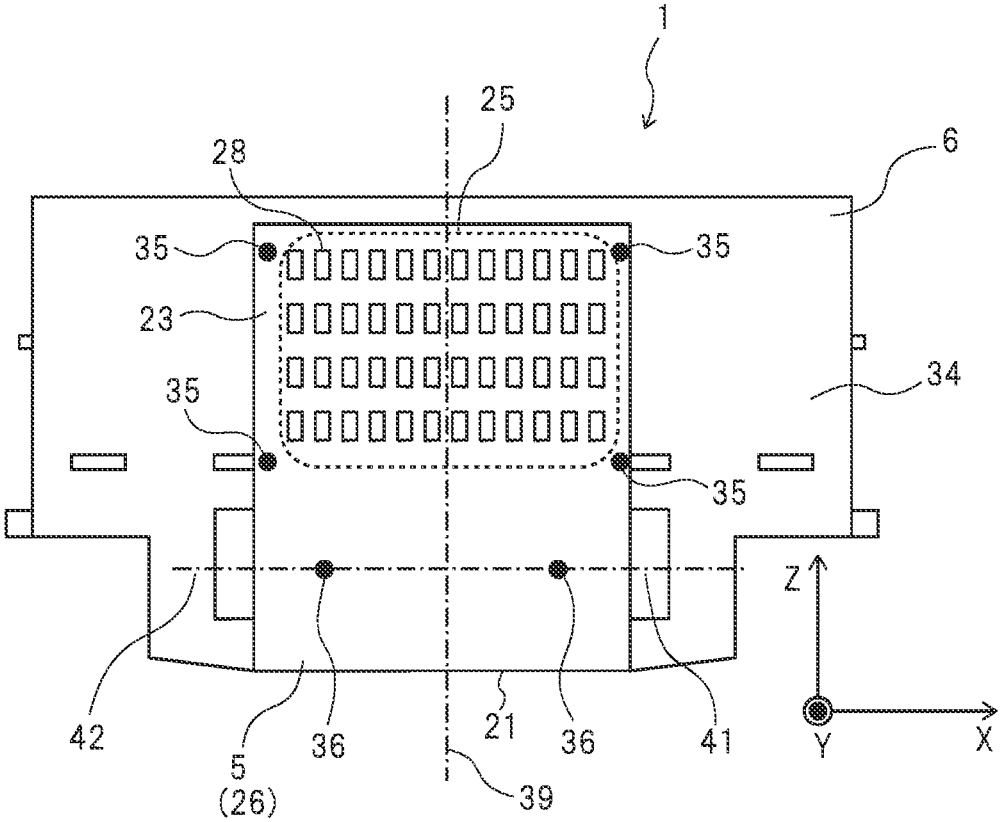
FIG. 6 is a partial side view of a housing according to the embodiment of the present invention.

FIG. 6 is a side view of the housing 6 as viewed from the direction A of FIG. 1 (upside down with respect to FIG. 1). The first fixing positions 35 of the electrical wiring board 5 are arranged around the electrical signal input portion 25. In this embodiment, a total of four first fixing positions 35 are arranged at four corners of the electrical signal input portion 25, respectively. As illustrated in FIG. 2B, a circular opening 37 is formed at each of the first fixing positions 35 of the electrical wiring board 5 (also see FIG. 7B). On the other hand, on the second surface 34 of the housing 6 at a position corresponding to each opening 37 of the first fixing position 35, a cylindrical pin 38 is formed so as to extend perpendicularly from the second surface 34. The pin 38 passes through the corresponding opening 37 so that the root and the tip of the pin 38 are located on both sides of the electrical wiring board 5 across the electrical wiring board 5. A tip 39 of the pin 38 is deformed to fix the electrical wiring board 5 at that position. As described above, the electrical wiring board 5 is fixed to the housing 6 by crimping at the plurality of first fixing positions 35.

The second fixing position 36 of the electrical wiring board 5 is located at a position closer to the bent portion 21 than any of the first fixing positions 35 with respect to the second surface 34. There is at least one second fixing position 36. As long as those conditions are satisfied, an arbitrary number of two or more second fixing positions 36 can be arranged at arbitrary positions. In this embodiment, a total of two second fixing positions 36 are arranged at respective symmetric positions with respect to a center line 39 of the electrical wiring board 5, which extends in a direction (Z direction) orthogonal to the bent portion 21. As illustrated in FIG. 2C, a circular opening 40 is formed at each of the second fixing positions 36 of the electrical wiring board 5 (see also FIG. 7B). By increasing the number of the second fixing positions 36, the number of the fixing positions increases, and thus the warping and wrinkling of the electrical wiring board 5 can be effectively suppressed. Note that, electrical wiring densely extends on the electrical wiring board 5, and hence it is desired that the second fixing position 36 (opening 40) be arranged so as not to affect the electrical wiring.

In the second surface 34 of the housing 6 at a position corresponding to the respective openings 40 of the second fixing positions 36, a groove-like depressed portion 41 is formed so as to extend substantially parallel to the bent portion 21 (substantially in an X direction). As illustrated in FIG. 2C, the depressed portion 41 is a groove having a shape obtained by cutting a cylindrical body having an elliptical cross section along the long axis of the elliptical cross section or along a line parallel to the long axis. It is preferred that a width W of the groove in the Z direction be larger than a maximum depth d of the groove. From the deepest positions of the groove, that is, from each of two positions on a center line 42 of the groove, a cylindrical pin 43 is formed so as to extend perpendicularly to the second surface 34. The pin 43 passes through the corresponding opening 40 so that the root and the tip of the pin 43 are located on both sides of the electrical wiring board 5 across the electrical wiring board 5. A tip 44 of the pin 43 is deformed so as to fix the electrical wiring board 5 at that position. As described above, the second part 23 of the electrical wiring board 5 is fixed to the housing 6 by crimping at the two second fixing positions 36 located inside the depressed portion 41.

In this embodiment, at both the first and second fixing positions 35 and 36, crimping is performed by melting the tips of the resin pins 38 and 43 by ultrasonic waves or heat, but the method of melting the tips of the pins 38 and 43 is not limited thereto. The method of fixing the electrical wiring board 5 at the first and second fixing positions 35 and 36 is not limited to crimping, and an adhesive may be used, for example.

At the second fixing position 36, the electrical wiring board 5 is pressed into the depressed portion 41. As an exemplary embodiment, the electrical wiring board 5 is curved along the side wall of the depressed portion 41 inside the depressed portion 41 so as to have substantially the same shape as the depressed portion 41. However, the electrical wiring board 5 is not required to be curved along the side wall of the depressed portion 41 inside the depressed portion 41. Further, the electrical wiring board 5 is not required to be pressed into the depressed portion 41 in part or entirely.

Figure 12A:
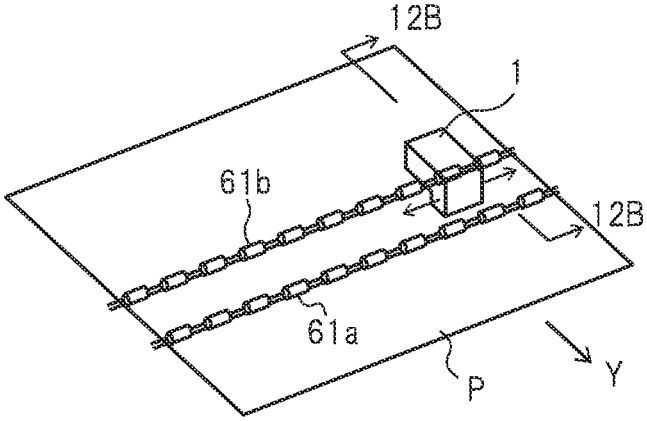
FIGS. 12A and 12B are schematic views illustrating the problems solved by the present invention.
Figure 12B:
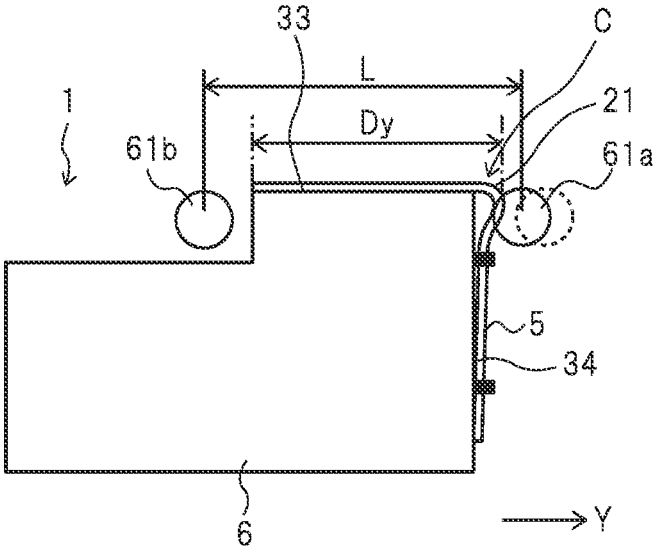

In the electrical wiring board 5 of this embodiment, the contact pad 28 is formed on the flexible wiring board, and hence the cost reduction effect is high. However, warping or wrinkling may occur depending on the length or material of the flexible wiring board 26. Warping or wrinkling tends to occur in the second part 23 in the vicinity of the bent portion 21, which directly affects the Y direction dimension Dy of the liquid ejection head 1 in this part. A sheet pressing roller 61*a* similar to that illustrated in FIGS. 12A and 12B is located in the vicinity of the bent portion 21. In order to avoid the interference between the sheet pressing roller 61*a* and the warping or wrinkling, it is necessary to separate the sheet pressing roller 61*a* away from the liquid ejection head 1. An interval L between sheet pressing rollers 61*a* and 61*b* (see FIG. 12B) is thus increased, which leads to reduction in sheet pressing performance. The depressed portion 41 is formed in the housing 6 of the liquid ejection head 1 itself, and the flexible wiring board 26 is depressed to be pressed toward the depressed portion 41 and fixed. In this manner, the increase in the Y direction dimension Dy of the liquid ejection head 1 in the vicinity of the bent portion 21 can be suppressed.

The length and position of the depressed portion 41 are adjusted so that at least the entire width of the electrical wiring board 5 in the X direction is included therein. The depressed portion 41 is preferred to be formed at a position at which the warping or wrinkling tends to occur if the depressed portion 41 is absent. In this embodiment, the length of the depressed portion 41 is smaller than the width of the second surface 34 of the housing 6, but the length of the depressed portion 41 may be the same as the width of the second surface 34, that is, the depressed portion 41 may pass across the second surface 34 in the X direction. Further, the cross section of the depressed portion 41 taken along the Y-Z plane may be a shape obtained by cutting a circle by a desired straight line, a rectangular shape, or a triangular shape, in addition to the above-mentioned shape obtained by cutting an ellipse. Both edge portions of the depressed portion 41 in the Z direction may be rounded so that the side walls of the depressed portion 41 are smoothly connected to the second surface 34.

At least one of the second fixing positions 36, preferably both of the second fixing positions 36 are located closer to the center line 39 of the electrical wiring board 5 which extends in a direction (Z direction) orthogonal to the bent portion 21 than any of the first fixing positions 35. In other words, at least one of the second fixing positions 36 is located closer to a position on the center line 39 of the electrical wiring board 5 than any of the first fixing positions 35 in regard to the width direction (X direction) of the flexible wiring board 26, which is orthogonal to the wiring of the flexible wiring board 26. When the second fixing position 36 is located farther from the center line 39 of the electrical wiring board 5 than the first fixing position 35 or is located at the same distance from the center line 39 of the electrical wiring board 5 as the first fixing position 35, warping protruding in the Y direction of the flexible wiring board 26 is eliminated, but warping protruding in the X direction of the flexible wiring board 26 may still tend to remain.

The electrical wiring board 5 may include a multilayer substrate including the contact pad 28, which is harder than the flexible wiring board 26 and is electrically and physically connected to the flexible wiring board 26. The flexible wiring board 26 includes a large number of complex wiring lines arranged in a single layer, and hence the size of the contact pad 28 increases. With use of the multilayer substrate, the liquid ejection head 1 itself can be formed compact. The multilayer substrate has a total of four openings 37 respectively formed at the four corners around the contact pad 28, and is fixed to the second surface 34 of the housing 6 by crimping. The second fixing position 36 is located on the flexible wiring board 26, and the flexible wiring board 26 is fixed to the housing 6 in a manner similar to the above. Even in the electrical wiring board 5 using the multilayer substrate, the flexible wiring board 26 may warp or wrinkle depending on the length or configuration of the flexible wiring board 26, and a similar effect may be achieved by pressing the flexible wiring board 26 into the depressed portion 41.

Next, the procedure for producing the liquid ejection head 1 is described.

Figure 7A:
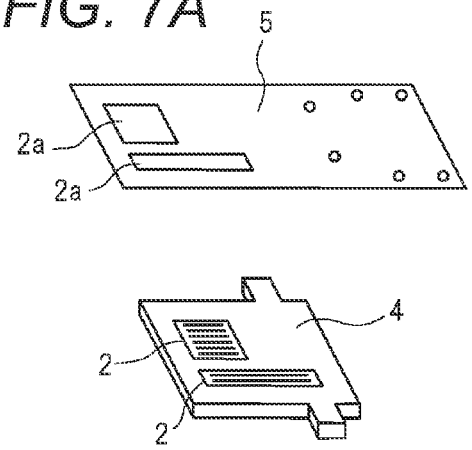
FIGS. 7A, 7B, 7C, 7D, 7E and 7F are schematic views illustrating steps of producing the liquid ejection head according to the embodiment of the present invention.

First, as illustrated in FIG. 7A, the support member 4 having the recording element substrate 2 bonded thereon and the electrical wiring board 5 are prepared. In the case of an embodiment without the support member 4, the recording element substrate 2 and the electrical wiring board 5 are prepared. As illustrated in FIG. 7B, the flexible wiring board 26 has a plurality of openings 37 and 40 for crimping formed in advance, and the wiring is formed so as to avoid the openings 37 and 40. The recording element substrate 2 is fixed to an opening portion 2*a*.

Next, the support member 4 having the recording element substrate 2 bonded thereon is bonded to the housing (not shown). Then, as illustrated in FIG. 7C, the electrical wiring board 5 is bonded to the support member 4. Specifically, a high temperature thermosetting adhesive is applied in advance to the support substrate 12 of the support member 4. Then, the position of the electrical wiring board 5 is adjusted, and the electrical wiring board is bonded to the support member 4. After that, the support substrate terminal 18 of the support substrate 12 and the electrical wiring board terminal 29 of the electrical wiring board 5 are electrically connected to each other by inner lead bonding (ILB), and the connection portion is sealed for electrical insulation and connection portion fixation. Instead of this embodiment, the support member 4 may be bonded to the housing 6 in advance. Next, the electrical wiring board 5 may be connected to the recording element substrate 2 by ILB, and then the connection portion may be sealed. After that, those members may be mounted on the support member 4 together.

Figure 7E:
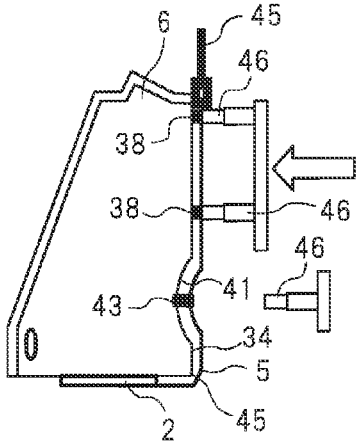
Figure 7B:
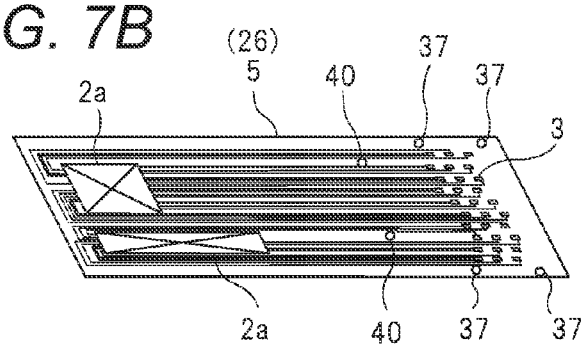
Figure 7F:
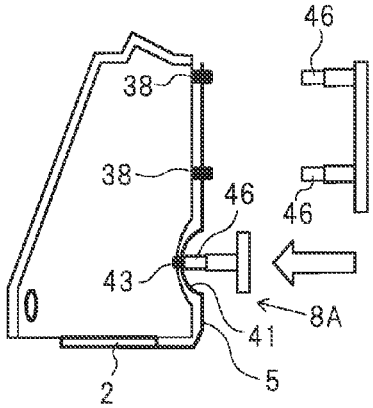
Figure 7C:
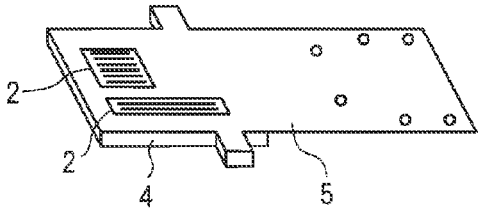
Figure 7D:
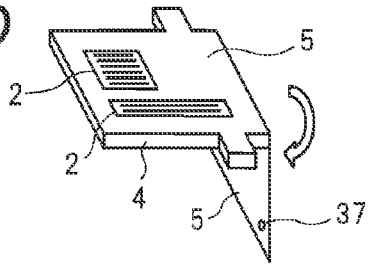

Next, as illustrated in FIGS. 7D and 7E, the electrical wiring board 5 is bent by about 90° toward the second surface 34 of the housing 6 at the periphery of a corner 45 of the housing 6 so as to cause the electrical wiring board 5 to follow the second surface 34 of the housing 6. In this case, it is preferred that, as illustrated in FIG. 7E, the leading end portion of the electrical wiring board 5 be nipped by an electrical wiring board presser 45, and the electrical wiring board 5 be bent without being extended. In this embodiment, the electrical wiring board 5 is not tensioned, but the electrical wiring board 5 may be weakly tensioned within a range that does not affect the electrical wiring board 5. In this case, the electrical wiring board 5 may be pulled by hooking a part of an apparatus through the opening 37 at the first fixing position 35 of the electrical wiring board 5. Alternatively, the leading end of the electrical wiring board 5 may be nipped and pulled with a tool.

On the second surface 34 of the housing 6, the pins 38 corresponding to the first fixing positions 35, the depressed portion 41 corresponding to the second fixing positions 36, and the pin 43 located inside the depressed portion 41 are formed in advance. The depressed portion 41 and the pins 38 and 43 may be formed in advance with a mold for molding the housing, or may be formed by cutting or thermal melting after the molding. The depressed portion 41 and the pins 38 and 43 are only required to be formed before the electrical wiring board 5 is bonded to the housing 6.

Next, as illustrated in FIG. 7E, under a state in which the leading end portion of the electrical wiring board 5 is nipped by the electrical wiring board presser 45, the electrical wiring board 5 is fixed to the housing 6 at the first fixing positions 35. The openings 37 of the electrical wiring board 5 are aligned to the corresponding pins 38 of the housing 6 so that the openings 37 allow the pins 38 to pass therethrough, respectively. In this case, the electrical wiring board presser 45 may slightly pull the electrical wiring board 5 so as to align the openings 37 to the pins 38, respectively. The tips of the pins 38 are heated and melted by a thermally welding heater 46 from the front side, to thereby crimp the electrical wiring board 5 to the housing 6 at the first fixing positions 35. It is preferred that the same number of the thermally welding heaters 46 as the first fixing positions 35 be provided so that all of the pins 38 are simultaneously crimped.

Figure 8A:
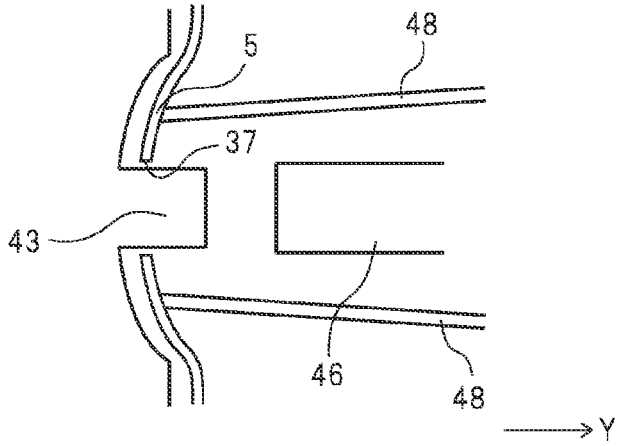
FIGS. 8A and 8B are detailed views of the periphery of a second fixing position.
Figure 8B:
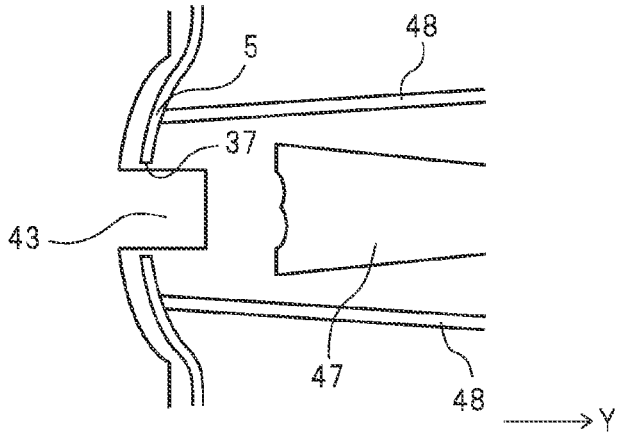

Next, as illustrated in FIG. 7F, the electrical wiring board 5 is fixed to the housing 6 at the second fixing positions 36. As described above, the depressed portion 41 is formed in the second surface 34 of the housing 6, and two pins 43 are formed inside the depressed portion 41. FIG. 8A is an enlarged view of the part 8A of FIG. 7F. An electrical wiring board presser 48 provided around the thermally welding heater 46 is used to press the electrical wiring board 5 so that the electrical wiring board 5 is curved so as to follow the shape of the depressed portion 41. Under this state, the opening 40 of the electrical wiring board 5 is aligned to the corresponding pin 43 of the housing 6 so that the opening 40 allows the pin 43 to pass therethrough. The tip of the pin 43 is heated and melted by the thermally welding heater from the front side, to thereby crimp the electrical wiring board 5 to the housing 6 at the second fixing position 36. It is preferred that the same number of the thermally welding heaters 46 as that of the second fixing positions 36 be provided so that all of the pins 43 are simultaneously crimped. The electrical wiring board presser 48 is preferred to be formed of a member having high vibration absorption performance and low heat transfer performance. As illustrated in FIG. 8B, a horn 47 for generating ultrasonic waves may be used instead of the thermally welding heater 46.

According to this embodiment, the electrical wiring board 5 is first fixed to the housing 6 at the first fixing positions 35, and then fixed to the housing 6 at the second fixing position 36. Therefore, crimping failure hardly occurs even if the heights of the pins 38 and 43 deviate at the first fixing positions 35 and the second fixing position 36. Further, the electrical wiring board 5 is first fixed at the first fixing positions 35, and hence the loosened state of the electrical wiring board 5 between the bent portion 21 and the first fixing positions 35 can be grasped. By adjusting the Y direction position to press the thermally welding heater 46 or the horn 47 depending on the loosened state of the electrical wiring board 5, the electrical wiring board 5 is satisfactorily pressed along the depressed portion 41 of the housing 6, and thus the crimping failure can be prevented.

Second Embodiment

Figure 9:
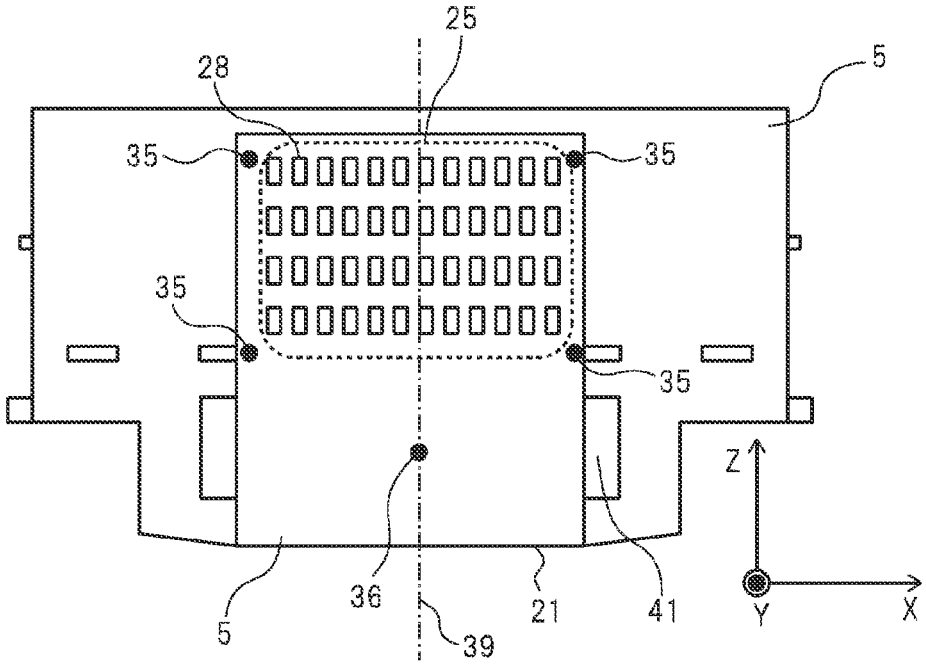
FIG. 9 is a partial side view of a housing according to a second embodiment of the present invention.

With reference to FIG. 9, a second embodiment of the present invention is described. In this embodiment, there is only one second fixing position 36. The one second fixing position 36 is located on the center line 39 of the electrical wiring board 5, which extends in the direction orthogonal to the bent portion 21. First, the electrical wiring board 5 is crimped at the first fixing positions 35 by a method similar to that in the first embodiment, and then the electrical wiring board 5 is crimped at the second fixing position 36 by a method similar to that in the first embodiment. Other features relating to the configuration, the used members, and the producing method of the ink jet liquid ejection head 1 are the same as those in the first embodiment.

Third Embodiment

Figure 10A:
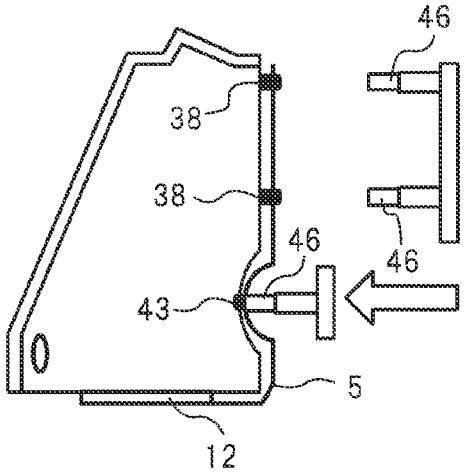
FIGS. 10A and 10B are schematic views illustrating a third embodiment of the present invention.
Figure 10B:
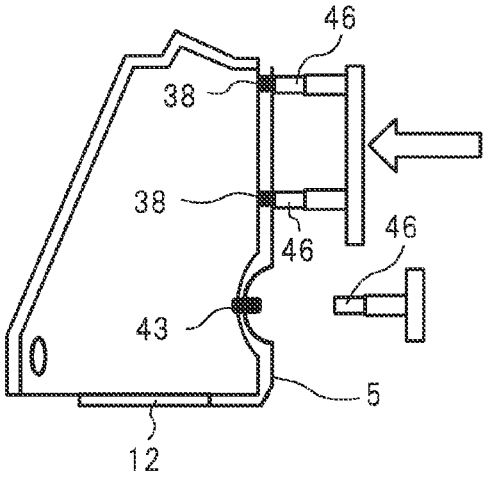

With reference to FIGS. 10A and 10B, a third embodiment of the present invention is described. In this embodiment, the electrical wiring board 5 is first fixed at the second fixing position 36, and then is fixed at the first fixing positions 35. First, by a method similar to that in the first embodiment, the electrical wiring board 5 is pressed into the depressed portion 41 so that the electrical wiring board 5 follows the shape of the depressed portion 41 of the housing 6, and the pin 43 is aligned to the opening 40 at the second fixing position 36. Simultaneously therewith, by a method similar to that in the first embodiment, the pins 38 are aligned to the openings 37 at the first fixing positions 35, respectively. As illustrated in FIG. 10A, under a state in which the electrical wiring board 5 is pressed so as to follow the shape of the depressed portion 41 of the housing 6, by a method similar to that in the first embodiment, the electrical wiring board 5 is first crimped at the second fixing position 36. After that, as illustrated in FIG. 10B, under a state in which the pins 38 are aligned to the openings 37, respectively, by a method similar to that in the first embodiment, the electrical wiring board 5 is crimped at the first fixing positions 35. In this embodiment, the second fixing position 36 is first fixed. Therefore, a curved portion of the electrical wiring board 5 inside the depressed portion 41 is less tensioned, which enables reduction in damage to the electrical wiring board during production. Other features relating to the configuration, the used members, and the producing method of the ink jet liquid ejection head 1 are the same as those in the first embodiment.

Fourth Embodiment

Figure 11:
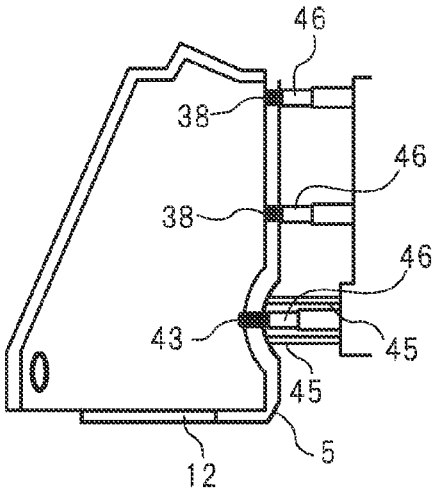
FIG. 11 is a schematic view illustrating a fourth embodiment of the present invention.

With reference to FIG. 11, a fourth embodiment of the present invention is described. In this embodiment, the electrical wiring board 5 is crimped simultaneously at the first and second fixing positions 35 and 36. First, by a method similar to that in the first embodiment, the electrical wiring board 5 is pressed into the depressed portion 41 of the housing 6 so as to follow the shape of the depressed portion 41. Next, under this state, the electrical wiring board 5 is crimped simultaneously at all of the first and second fixing positions 35 and 36. In this embodiment, the liquid ejection head 1 can be produced without extending the takt time. Other features relating to the configuration, the used members, and the producing method of the ink jet liquid ejection head 1 are the same as those in the first embodiment.

As described above, according to the present invention, it is possible to provide the liquid ejection head and the method of producing the liquid ejection head, which are capable of suppressing protrusion due to lifting of the electrical wiring board fixed to the housing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-235145, filed Nov. 13, 2013, which is hereby incorporated by reference herein in its entirety.

What is claimed is:

1. A liquid ejection head, comprising:

a recording element substrate for ejecting liquid in response to an electrical signal supplied from the outside;

an electrical wiring board having a first part and a second part that are joined to each other via a bent portion, the first part comprising an electrical joint portion for supplying the electrical signal to the recording element substrate, the second part comprising an electrical signal input portion into which the electrical signal is input and to which the electrical joint portion is connected; and a housing having a first surface and a second surface that are adjacent to each other, the first surface supporting the first part, the second surface supporting the second part, wherein:

the second part of the electrical wiring board is fixed to the second surface of the housing at a plurality of first fixing positions around the electrical signal input portion, the second surface comprises a depressed portion formed closer to the bent portion than the plurality of first fixing positions, the second part is fixed to the housing further at at least one second fixing position located inside the depressed portion.

2. A liquid ejection head according to claim 1, wherein the at least one second fixing position is located closer to a center line of the electrical wiring board which extends in a direction orthogonal to the bent portion than any of the plurality of first fixing positions.

3. A liquid ejection head according to claim 1, wherein the at least one second fixing position comprises two or more second fixing positions.

4. A liquid ejection head according to claim 1, wherein the at least one second fixing position comprises one second fixing position located on a center line of the electrical wiring board which extends in a direction orthogonal to the bent portion.

5. A liquid ejection head according to claim 1, wherein the electrical wiring board comprises a flexible wiring board, and wherein the electrical signal input portion is formed on the flexible wiring board.

6. A liquid ejection head, comprising:

a recording element substrate comprising an element for generating energy to be used for ejecting liquid;

an electrical wiring board comprising:

a bent portion;

a connection portion which is provided on a first part on one side of the bent portion and which is for connection with the recording element substrate; and an input portion which is provided on a second part on the other side of the bent portion and to which a signal to be supplied to the recording element substrate is input; and a housing comprising:

a first surface for supporting the first part of the electrical wiring board;

a second surface for supporting the second part of the electrical wiring board; and a depressed portion formed in the second surface, wherein a region between the bent portion and the input portion in the electrical wiring board is fixed to the depressed portion.

7. A liquid ejection head according to claim 6, wherein the depressed portion has a curved shape.

8. A liquid ejection head according to claim 6, wherein the fixation to the depressed portion is conducted with an opening formed in the electrical wiring board and a pin formed in the housing.

9. A liquid ejection head according to claim 6, wherein the fixation to the depressed portion is conducted with an adhesive.

10. A method of producing a liquid ejection head, comprising:

fixing, to a first surface of a housing, a first part of an electrical wiring board including an electrical signal input portion into which an electrical signal supplied from the outside is input and an electrical joint portion for supplying the electrical signal to a recording element substrate for ejecting liquid in response to the electrical signal, the electrical joint portion being electrically connected to the electrical signal input portion, the first part including the electrical joint portion;

bending a second part of the electrical wiring board wherein the electrical signal input portion is provided with respect to the first part so as to form a bent portion;

fixing the bent second part of the electrical wiring board to a second surface of the housing which is adjacent to the first surface at a plurality of first fixing positions around the electrical signal input portion; and fixing the bent second part of the electrical wiring board to the housing at at least one second fixing position located inside a depressed portion formed in the second surface, the at least one second fixing position being located closer to the bent portion than any of the plurality of first fixing positions.

11. A method of producing a liquid ejection head according to claim 10, wherein at least one second fixing position is located closer to a center line of the electrical wiring board which extends in a direction orthogonal to the bent portion than any of the plurality of first fixing positions.

12. A method of producing a liquid ejection head according to claim 10, wherein the at least one second fixing position comprises two or more second fixing positions.

13. A method of producing a liquid ejection head according to claim 10, wherein the fixing of the bent second part at the plurality of first fixing positions is carried out prior to the fixing of the bent second part at the at least one second fixing position.

14. A method of producing a liquid ejection head according to claim 10, wherein the fixing of the bent second part at the plurality of first fixing positions is carried out after the fixing of the bent second part at the at least one second fixing position.

15. A method of producing a liquid ejection head according to claim 10, wherein the fixing of the bent second part at the plurality of first fixing positions is carried out simultaneously with the fixing of the bent second part at the at least one second fixing position.

16. A method of producing a liquid ejection head according to claim 10, wherein the electrical wiring board comprises a flexible wiring board, and wherein the electrical signal input portion is formed on the flexible wiring board.

* * * * *